US012292255B2

(12) United States Patent
Kusnierz

(10) Patent No.: US 12,292,255 B2
(45) Date of Patent: May 6, 2025

(54) ADJUSTABLE STOCK

(71) Applicant: Smith & Wesson Inc., Maryville, TN (US)

(72) Inventor: Zachary Kusnierz, Westfield, MA (US)

(73) Assignee: Smith & Wesson Inc., Maryville, TN (US)

( * ) Notice: Subject to any disclaimer, the term of this patent is extended or adjusted under 35 U.S.C. 154(b) by 19 days.

(21) Appl. No.: 18/448,630

(22) Filed: Aug. 11, 2023

(65) Prior Publication Data

US 2024/0053120 A1 Feb. 15, 2024

Related U.S. Application Data

(60) Provisional application No. 63/397,441, filed on Aug. 12, 2022.

(51) Int. Cl.
*F41C 23/14* (2006.01)
*F41C 23/08* (2006.01)

(52) U.S. Cl.
CPC ..... *F41C 23/14* (2013.01); *F41C 23/08* (2013.01)

(58) Field of Classification Search
CPC ..... F41C 23/08; F41C 23/14
See application file for complete search history.

(56) References Cited

U.S. PATENT DOCUMENTS 2,673,414 A 3/1954 Arnold
2,956,343 A * 10/1960 Shaffer ..... F41C 23/14 33/506
3,267,602 A 8/1966 Arthur
4,122,623 A * 10/1978 Stice ..... F41C 23/14 42/73
5,235,764 A * 8/1993 Perazzi ..... F41C 23/14 42/73
5,970,642 A 10/1999 Martin
6,427,372 B1 8/2002 Howard
6,688,031 B2 * 2/2004 Steele ..... F41C 23/14 42/71.01
7,124,529 B1 10/2006 Havelka, Jr.
7,200,966 B2 4/2007 Gooder
8,381,628 B1 2/2013 Wheatley
8,453,365 B1 6/2013 Ballard
8,656,622 B2 2/2014 Peterson et al.
8,720,099 B1 5/2014 Sisk
8,763,296 B1 7/2014 Chvala
8,844,185 B2 9/2014 Jarboe
8,984,790 B2 3/2015 Wilson et al.
9,360,272 B2 6/2016 Hopkins
9,410,764 B2 8/2016 Jarboe
9,464,863 B2 10/2016 Mather
(Continued)

*Primary Examiner* — Bret Hayes
(74) *Attorney, Agent, or Firm* — Ballard Spahr LLP

(57) ABSTRACT

A stock has a buttstock. The buttstock includes an adjustable comb. The comb is connected to a body of the buttstock via a rod extending into the body of the buttstock and movable along a first axis. The position of the rod and comb is locked and unlocked by a latch. The buttstock includes an adjustable recoil pad. The recoil pad is connected to the body via a threaded rod mated with a nut embedded within an end of the body. The threaded rod and recoil pad move a direction along a longitudinal axis of the body depending on the rotation of the nut.

20 Claims, 7 Drawing Sheets

(56) References Cited

U.S. PATENT DOCUMENTS

| | | | | |
|---|---|---|---|---|
| 9,506,708 | B2 | 11/2016 | Peterson et al. | |
| 9,541,347 | B2 | 1/2017 | Maugham | |
| 9,664,476 | B1 | 5/2017 | Robinson et al. | |
| 9,664,479 | B1 | 5/2017 | Robinson | |
| 9,696,111 | B2 | 7/2017 | Saadon | |
| 10,215,526 | B2 | 2/2019 | Shinkle | |
| 10,267,594 | B2 | 4/2019 | Saadon | |
| 10,788,287 | B2 | 9/2020 | Parker et al. | |
| 10,794,658 | B2 | 10/2020 | Walthert | |
| 10,866,060 | B2 | 12/2020 | Inneci | |
| 10,955,217 | B2 | 3/2021 | Saadon | |
| 11,168,955 | B2 | 11/2021 | Walthert | |
| 11,262,160 | B2 | 3/2022 | Haugen | |
| 11,274,901 | B2 | 3/2022 | Burgess | |
| 2014/0196343 | A1 | 7/2014 | Wilson et al. | |
| 2017/0122698 | A1* | 5/2017 | Chu | F41B 11/70 |
| 2018/0073835 | A1* | 3/2018 | Saltzman | F41C 23/06 |
| 2019/0093984 | A1* | 3/2019 | Lundbäck | F41C 23/14 |
| 2020/0355462 | A1 | 11/2020 | Inneci | |
| 2021/0048274 | A1 | 2/2021 | Hopkins | |
| 2021/0381799 | A1* | 12/2021 | Alomaira | F41C 23/14 |

* cited by examiner

ADJUSTABLE STOCK

CROSS-REFERENCE TO RELATED APPLICATION

This application claims the benefit of the filing date of U.S. Provisional Patent Application No. 63/397,441, filed Aug. 12, 2022, the entirety of which is hereby incorporated by reference herein.

FIELD OF THE INVENTION

This invention relates to stocks for firearms, in particular, adjustable stocks.

BACKGROUND

Gun fit is an important aspect of marksmanship as a proper gun fit is essential to accuracy, consistency and performance. An improper gun fit can lead to injury including bruising on the shooter's cheek, jawbone, or shoulder. It is important that various components of the firearm, such as comb height and length of pull, may be adaptable to the unique physique, eye dominance, and hand dominance of each shooter.

The height of the comb, the top portion of the stock where the shooter rests his or her cheek while shooting, affects the view and eye-line of the shooter. A comb height that is either too low or too high causes a poor view along the top of the barrel of the firearm and negatively impacts the shooter's aim.

The length of pull is the distance from the trigger to the back of the recoil pad. A length of pull that is either too short or too long causes a poor and uncomfortable stance and negatively impacts the shooter's control of the firearm.

There is clearly an opportunity to improve the adjustable components of firearms to customize the gun fit to each shooter.

SUMMARY

An example stock for a firearm according to the invention comprises a body, a chamber, a comb, a rod, and a latch. The body extends along a longitudinal axis. The chamber is positioned within the body. The chamber comprises an opening that provides access to the chamber. The comb is positioned on the body overlying the chamber. The rod is connected to the comb. The rod is configured to extend through the opening into the chamber. The latch is positioned within the chamber. The latch is movable between a first position and a second position. When in the first position, the latch engages the rod to fix a position of the comb. When in the second position, the latch does not engage the rod thereby permitting motion of the comb relative to the body. The rod and the comb are movable along a first axis. The first axis is oriented transversely to the longitudinal axis.

In an example embodiment, the latch comprises a sleeve positioned within the chamber and connected to the body and a plunger movable between the first position and the second position within the sleeve.

In an example embodiment, the plunger comprises a first engagement surface and the rod comprises a plurality of second engagement surfaces. The first engagement surface engages a second engagement surface of the plurality of second engagement surfaces on the rod when the plunger is in the first position. The first engagement surface does not engage with the plurality of second engagement surfaces when the plunger is in the second position.

In an example embodiment, the first engagement surface comprises a pin connected to the plunger. The plurality of second engagement surfaces comprises a plurality of notches arranged lengthwise along the rod. The pin engages with a notch of the plurality of notches when the plunger is in the first position. The pin is disengaged from the notch when the plunger is in the second position.

In an example embodiment the latch comprises a spring acting between the plunger and the body. The spring is pre-loaded to bias the plunger in the first position. The force acting on the plunger compresses the spring to move the plunger from the first position to the second position.

An example stock may further comprise a second rod and a second opening in the body. The second rod comprises a protrusion along a length of the second rod. The second rod is connect to the comb and movable along the first axis. The second opening provides access to the chamber. The second rod is configured to extend through the second opening into the chamber. The protrusion extends radially out from the second rod past the second opening to prevent the second rod from moving along the first axis into the chamber and to set a lower stopping point of the comb.

In an example embodiment, the protrusion comprises a ring positioned in the recess in the second rod. The ring has a diameter greater than a diameter of the second opening.

An example stock may further comprise a nut, a plate, a recoil pad, and a threaded rod. The nut is embedded in an end of the body. The nut is fixed translationally and rotatable about the longitudinal axis. The plate is connected to the end and overlies the nut. The plate comprises an opening providing access to the nut. The recoil pad is positioned on the end overlying the plate. The threaded rod is connected to the recoil pad. The threaded rod is configured to extend through the opening in the plate and mate with the nut. The threaded rod and the recoil pad are movable along the longitudinal axis by rotating the nut to adjust a length between the recoil pad and the end.

In an example embodiment, rotating the nut in a first direction moves the recoil pad closer to the plate and rotating the nut a second direction moves the recoil pad away from the plate.

An example stock may further comprise a detent positioned between the plate and the nut. The detent is configured to interact with at least one detent position on a surface of the nut.

In an example embodiment, the detent comprises a spring loaded ball bearing and each detent position of the at least one detent position comprises a recess in the surface.

In an example embodiment, the stock may further comprise a guide rod adjustably attached to the recoil pad via a fastener. The guide rod extends through a second opening in the plate and is movable along the longitudinal axis. The recoil pad comprises at least one slotted recess and a slotted opening positioned within the slotted recess. An end of the guide rod and a head of the fastener are positioned on either side of the slotted opening to allow the recoil pad to cant a first direction or a second direction within the boundary of the slotted recess.

An example stock for a firearm according to the invention comprises a body, a chamber, a comb, a rod, and a second rod. The body extends along a longitudinal axis. The chamber is positioned within the body. The chamber comprises an opening that provides access to the chamber. The comb is positioned on the body overlying the chamber. The rod is connected to the comb. The rod is configured to extend through the opening into the chamber. The rod and the comb are movable along a first axis. The first axis is oriented transversely to the longitudinal axis. The second rod comprises a protrusion positioned along a length of the second rod. The second rod is connected to the comb and movable along the first axis. The second opening in the body provides access to the chamber. The second rod is configured to extend through the second opening into the chamber. The protrusion extends radially out form the second rod past the second opening to prevent the second rod from moving along the first axis into the chamber to set a lower stopping point of the comb.

An example stock for a firearm according to the invention comprises a body. The body extends along a longitudinal axis. The stock further comprises a nut embedded in an end of the body. The nut is fixed translationally and rotatable about the longitudinal axis. A plate is connected to the end and overlies the nut. The plate comprises an opening providing access to the nut. A recoil pad is positioned on the end overlying the plate. A threaded rod is connected to the recoil pad. The threaded rod is configured to extend through the opening in the plate and mate with the nut. The threaded rod and the recoil pad are movable along the longitudinal axis by rotating the nut to adjust a length between the recoil pad and the end. A guide rod is adjustably attached to the recoil pad via a fastener. The guide rod extends through a second opening in the plate and is movable along the longitudinal axis. The recoil pad comprises at least one slotted recess and a slotted opening positioned within the slotted recess. An end of the guide rod and a head of the fastener are positioned on either side of the slotted opening to allow the recoil pad to cant a first direction or a second direction within the boundary of the slotted recess.

An example stock for a firearm according to the invention comprises a body, a chamber, a comb, a rod, and a latch. The body extends along a longitudinal axis. The chamber is positioned within the body. The chamber comprises an opening that provides access to the chamber. The comb is positioned on the body overlying the chamber. The rod is connected to the comb. The rod is configured to extend through the opening into the chamber. The latch is positioned within the chamber. The latch comprises a sleeve. The sleeve comprises projections configured to mate with a surface of the body which forms the chamber thereby fixing the sleeve within the chamber.

The invention also encompasses a firearm. In an example embodiment, the firearm comprises a barrel, a receiver, a firing mechanism, and a stock. The receiver is connected to the barrel. The firing mechanism is connected to the receiver. The stock is configured to connect to the barrel, the receiver, and the firing mechanism. The stock may include any and all combinations of the embodiments for the example stock described above.

DETAILED DESCRIPTION

Figure 1:
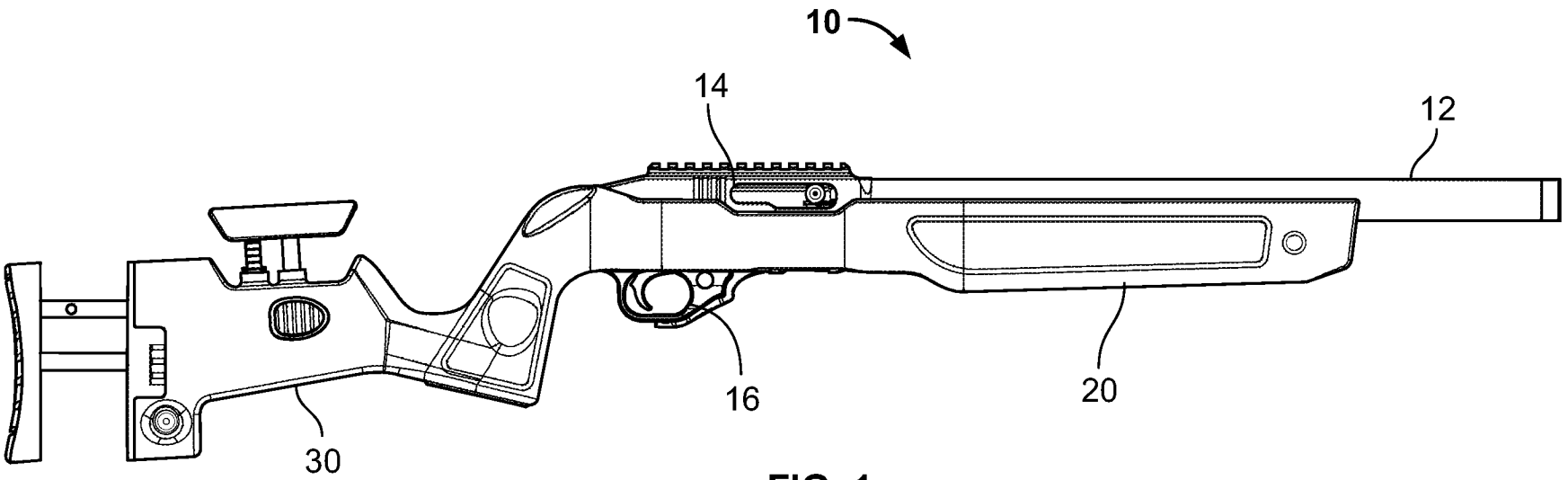
FIG. 1 is a side view of an example firearm according to the invention.

FIG. 1 shows a firearm, in this example a rifle 10. The rifle 10 comprises a stock 20 including a buttstock 30. The buttstock 30 is defined as the part of the stock 20 which engages the shooter's shoulder and cheek. The stock 20 supports a barrel 12, a receiver 14 and a firing mechanism 16. The stock 20 may be removeably engageable with the barrel 12, receiver 14, and firing mechanism 16.

Figure 2:
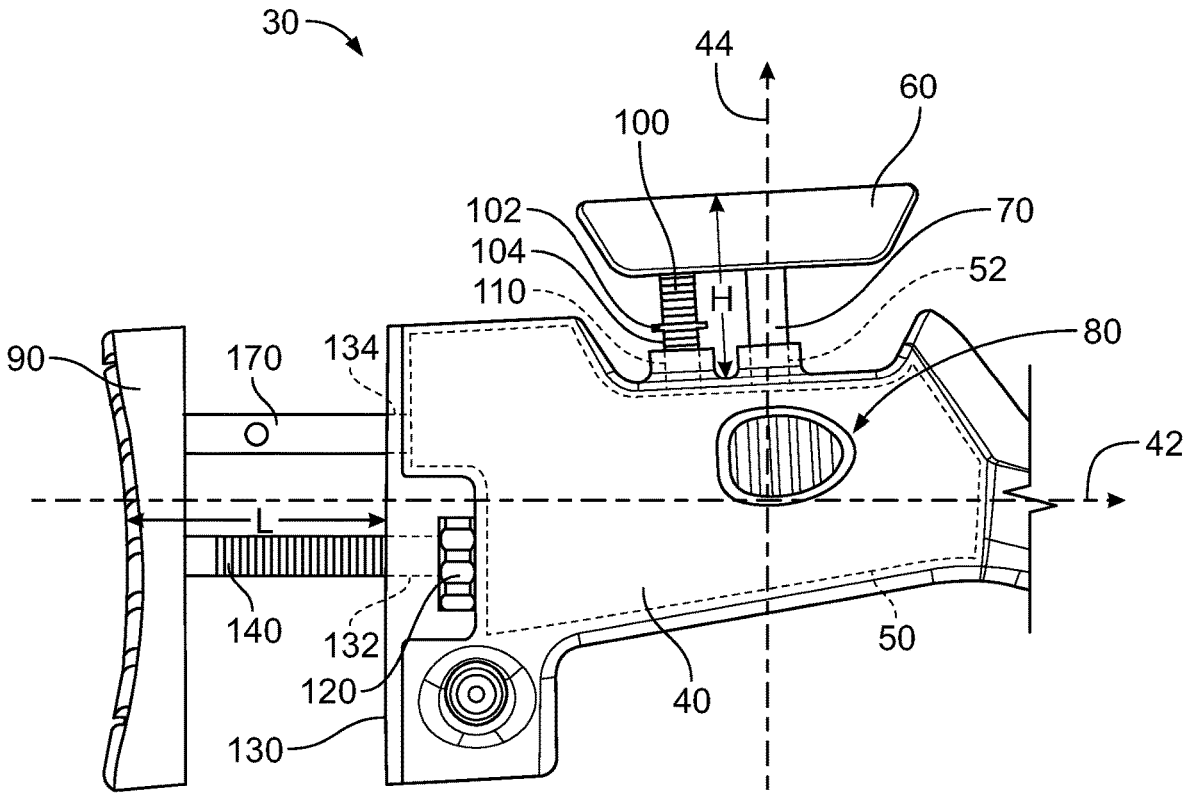
FIG. 2 is a side view of an example buttstock according to the invention.
Figure 4:
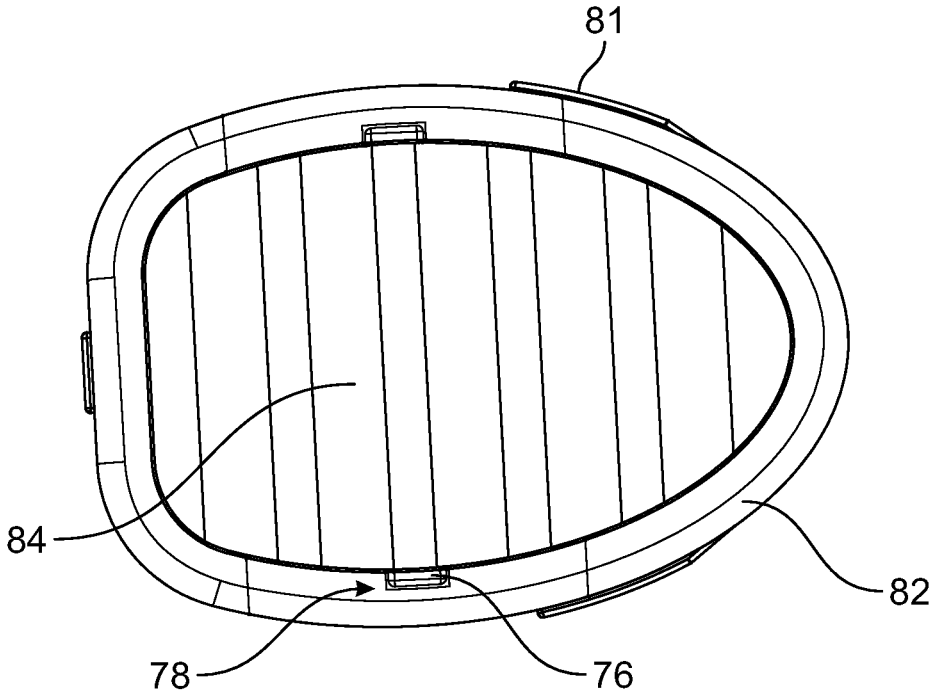
FIG. 4 is a front view of an example latch according to the invention.

FIG. 2 shows the example buttstock 30 in detail. The body 40 of the buttstock 30 extends along a longitudinal axis 42 extending lengthwise along the body 40. As shown in FIGS. 2 and 4, the buttstock 30 includes an adjustable comb 60 movably attached to the body 40. The comb 60 is defined as an upper surface of the buttstock 30 on which the shooter rests his or her cheek while shooting. The shooter may adjust the height H of the comb 60 wherein the height H is the distance between the upper surface of the comb 60 and the body 40 (e.g., the upper surface of the body) of the buttstock 30. The shooter may adjust the height H of the comb 60 to adjust the shooter's sightline down the barrel 12 of the firearm, in this example a rifle 10.

The comb 60 is movably attached to the body 40 via a rod 70. The rod 70 is connected to a lower surface of the comb 60. The rod 70 is configured to move along a first axis 44 that is oriented transversely (optionally, perpendicularly) to the longitudinal axis 42. As the rod 70 moves along the first axis 44, the comb 60 moves along the first axis 44 thereby varying the height H of the comb 60. The rod 70 extends through an opening 52 in an upper side of the body 40. The opening 52 provides access to a chamber 50 within the body 40 of the buttstock 30. As the rod 70 moves along the first axis 44, an end of the rod 70 moves within the chamber 50.

The position of the rod 70 may be locked and unlocked by a latch 80 positioned within the chamber 50. The latch 80 is movable between a first position and a second position, wherein the latch 80 engages the rod 70 to fix the position of the rod 70 and comb 60 when in the first position and disengages the rod 70 to permit movement of the rod 70 and comb 60 when in the second position. The height H of the comb 60 is fixed when the latch 80 is in the first position thereby preventing the comb 60 from being pushed down by the shooter's cheek when using the rifle 10. A shooter may adjust the height H of the comb 60 when the latch 80 is in the second position.

Figure 3:
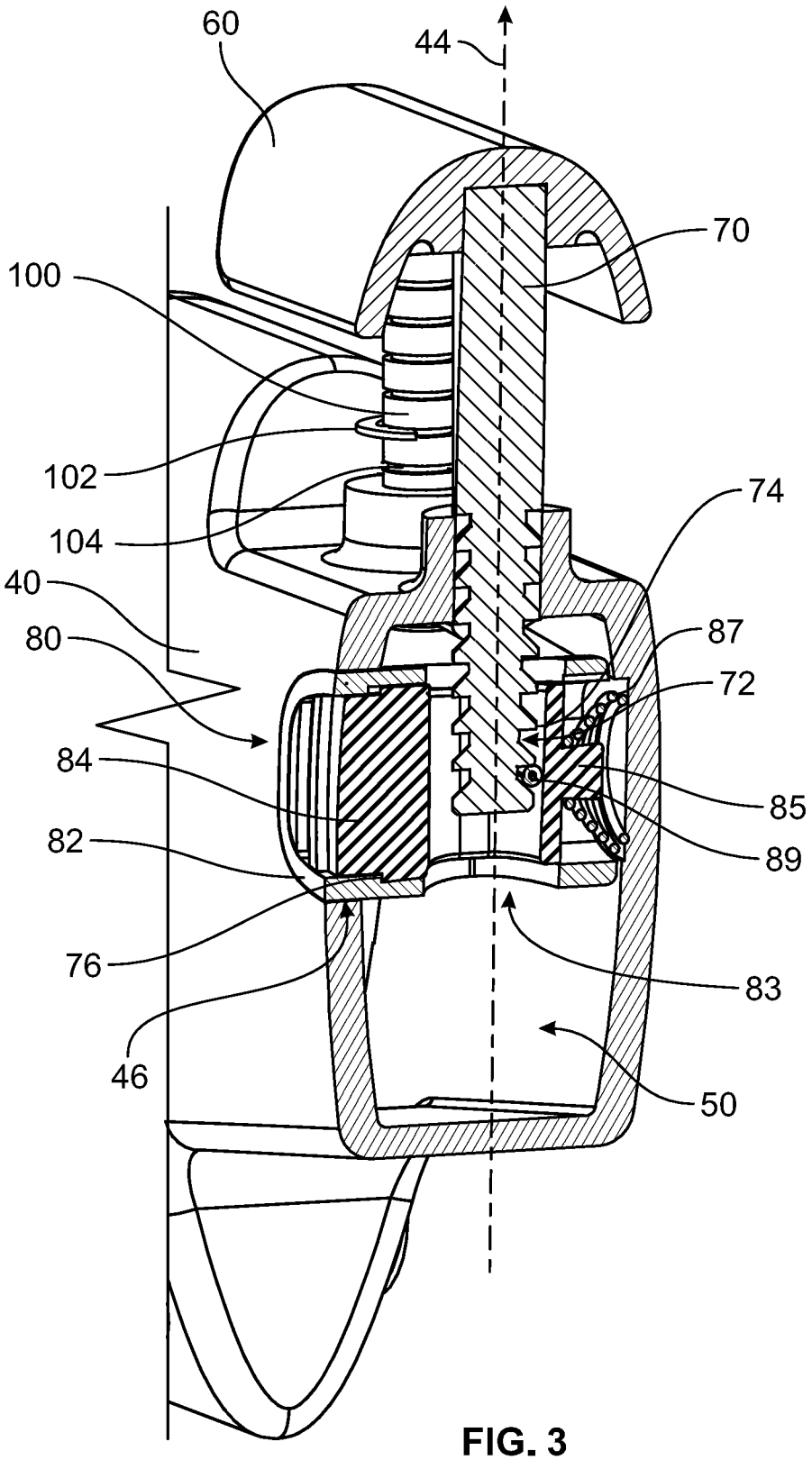
FIG. 3 is a section view of an example adjustable comb according to the invention.
Figure 5:
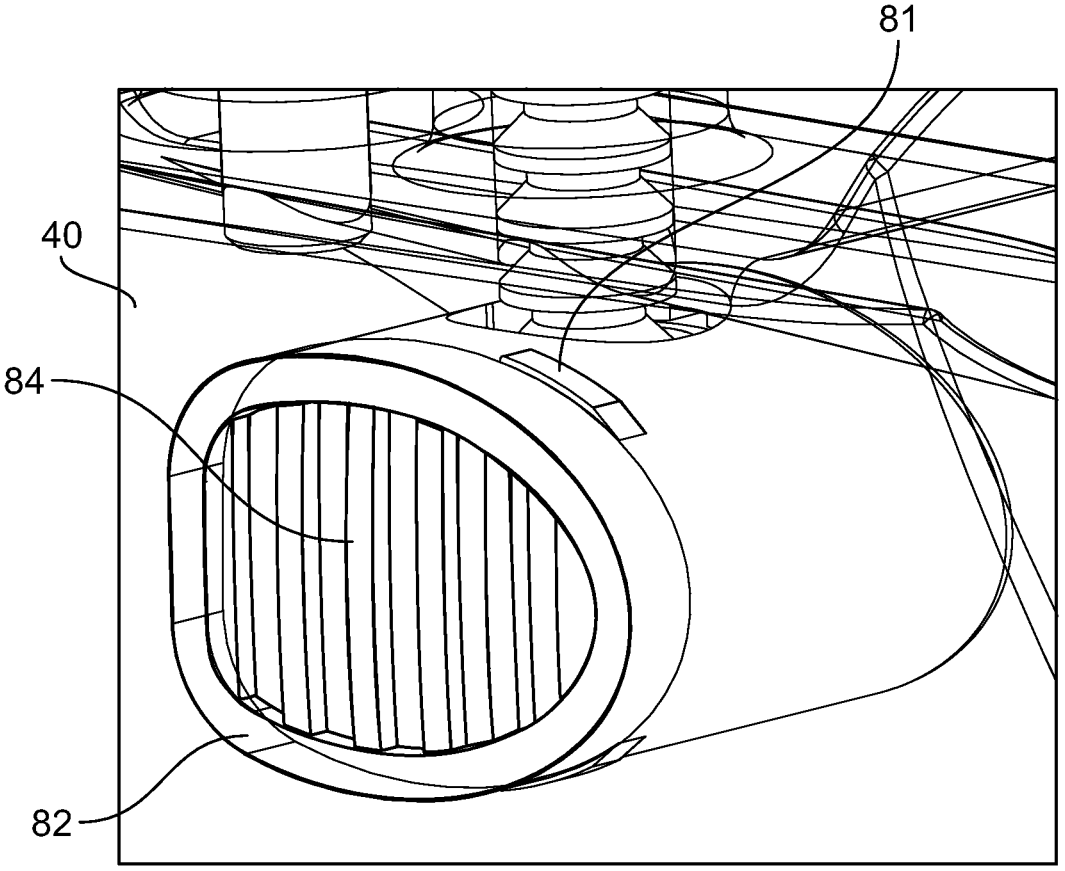
FIG. 5 is an isometric view of the example latch according to the invention.

FIG. 3 shows an example latch 80 in detail. In this example, the latch 80 may include a sleeve 82 and a plunger 84. The sleeve 82 is positioned within the chamber 50 and held stationary by the body 40 of the buttstock 30. As shown in FIGS. 4 and 5, the sleeve 82 may include projections 81 which mate with a surface of the body 40 which forms the chamber 50 thereby fixing the sleeve 82 within the chamber 50. The body 40 includes an opening 46 configured to receive the sleeve 82 and plunger 84 and to provide the sleeve 82 and plunger 84 access to the chamber 50. The opening 46 also provides a shooter access to a surface of the plunger 84. The sleeve 82 and plunger 84 comprise aligned bores to form a channel 83 through which the rod 70 may be received and may move along the first axis 44. The plunger 84 moves between the first position and the second position to latch and unlatch the rod 70, respectively. As shown in FIG. 4, the plunger 84 may include at least one projection 76 along an outer surface configured to slide within at least one corresponding slot 78 in an inner surface of the sleeve 82. The at least one slot 78 prevents the plunger 84 from sliding out of the sleeve 82 and the buttstock 30 when the comb 60 and rod 70 are removed from the buttstock 30. The plunger 84 comprises a first engagement surface and the rod 70 comprises a plurality of second engagement surfaces. The first engagement surface engages with one of the second engagement surfaces when the plunger 84 is in the first position thereby fixing the position of the rod 70 and the comb 60. The first engagement surface and second engagement surface disengage as the plunger 84 moves from the first position to the second position.

In this example, the first engagement surface may comprise a pin 89 connected to the plunger 84. As the plunger 84 moves, the pin 89 may move. The plurality of second engagement surfaces may comprise a plurality of notches 72 arranged lengthwise along the rod 70. The pin 89 engages with a notch 72 of the plurality of notches 72 when the plunger 84 is in the first position. When the pin 89 is engaged with a notch 72, the rod 70 is fixed and cannot move. When the pin 89 disengages from the notch 72 as the plunger 84 moves to the second position, the rod 70 is free to move along the first axis 44. The position of the comb 60 may be adjusted by disengaging the pin 89 from the notches 72, moving the rod 70 along the first axis 44, and engaging the pin 89 in a notch 72 when the comb 60 is at a desired position with respect to the body 40 of the buttstock 30.

The latch 80 may further include a spring 87 acting between the plunger 84 and the body 40 of the buttstock 30 within the chamber 50. The plunger 84 may include a post 85 extending through the center of the spring 87 to hold the spring 87 in position. The spring 87 may be pre-loaded to bias the plunger 84 in the first position. In this example, the spring 87 is pre-loaded to bias the pin 89 in a notch 72 in the rod 70. A force acting on the plunger 84, such as a shooter pressing the plunger 84 with a finger, may compress the spring 87 to move the plunger 84 from the first position to the second position. Thus, a shooter may adjust the comb 60 by pressing the plunger 84 and moving the comb 60 along the first axis 44 while the plunger 84 remains pressed. Alternatively, a shooter may adjust the comb 60 by pulling up on the comb 60 to overcome the force of the spring 87 acting on the plunger 84 so that the pin 89 slips past the notches 72 to a desired position. Each notch 72 may have a chamfered or rounded edge 74 enabling the pin 89 to slip past the notch 72.

As shown in FIGS. 2 and 3, a second rod 100 connected to a lower surface of the comb 60 may be used to limit the position of the comb 60. The second rod 100 extends through a second opening 110 in the body 40 of the buttstock 30 and into the chamber 50. As the comb 60 moves along the first axis 44, the second rod 100 moves along the first axis 44. The second rod 100 provides stability to the comb 60 by preventing the comb 60 from rotating about the rod 70. The second rod 100 may also include a protrusion 102 extending radially out from the second rod 100 to set a lower stopping point of the second rod 100 and the comb 60. The protrusion 102 extends out past the second opening 110 thereby stopping the second rod 100 from moving further into the chamber 50 when the protrusion 102 comes into contact with the body 40. A shooter may adjust the position of the protrusion 102 along the length of the second rod 100 to adjust the lower stopping point. In this example, the second rod 100 includes a plurality of recesses 104 along the length of the second rod 100 and the protrusion 102 is an E-clip positioned in a recess of the plurality of recesses 104. The shooter may move the E-clip to a desired recess 104 to change and set the lower stopping point.

Figure 6:
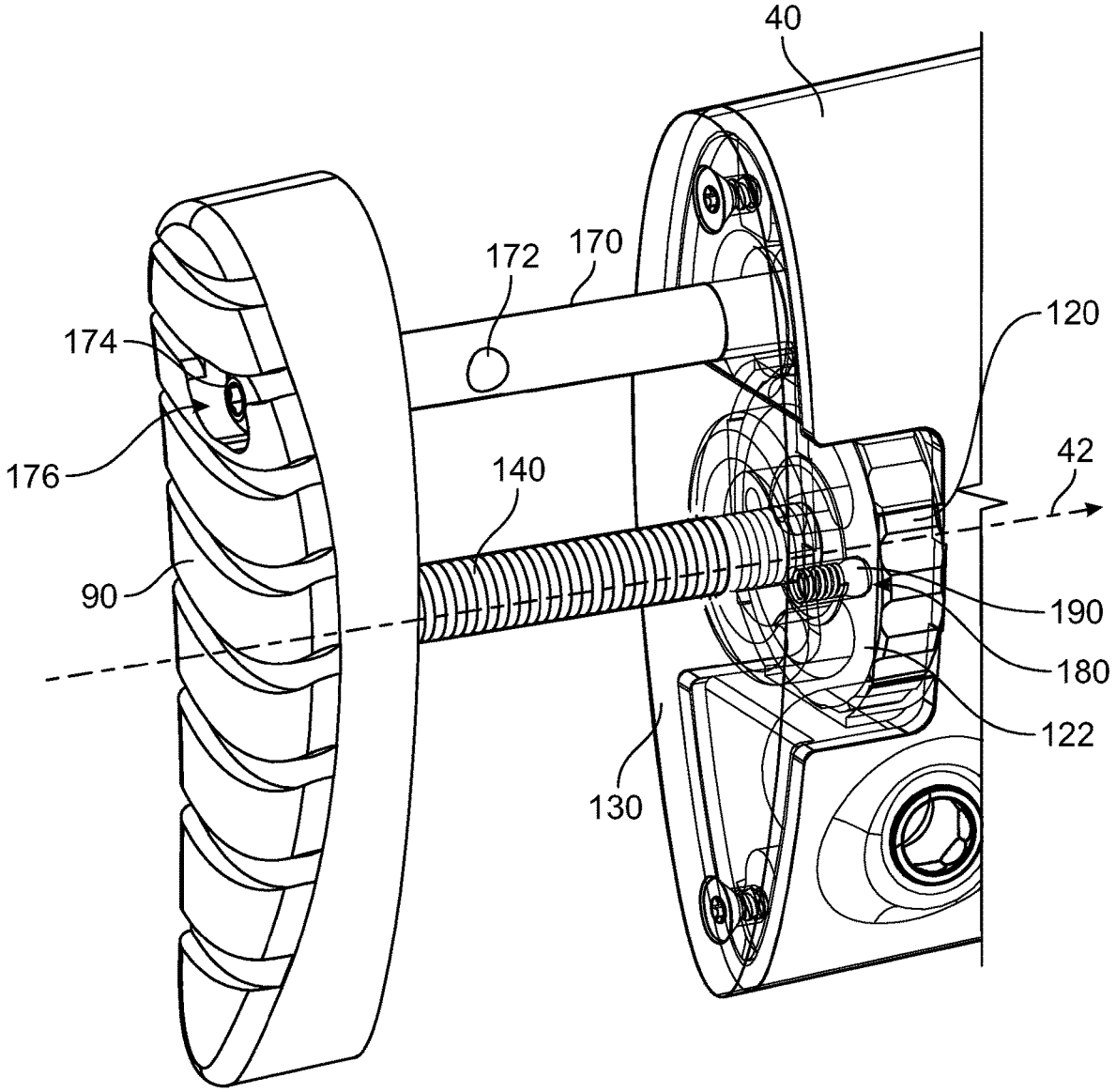
FIG. 6 is an isometric view of an example adjustable recoil pad according to the invention.

As shown in FIGS. 2 and 6, the example buttstock 30 may also comprise an adjustable recoil pad 90 movably attached to the body 40. The recoil pad 90 is defined as an end of the buttstock 30 which engages the shooter's shoulder. The shooter may adjust the length L of the recoil pad 90 wherein the length L is the distance between an exterior surface of the recoil pad 90 and the body 40 of the buttstock 30. The shooter may adjust the length L of the recoil pad 90 to adjust the length of pull of the rifle 10.

The recoil pad 90 is movably attached to the body 40 via a threaded rod 140. The threaded rod 140 is connected to an interior surface of the recoil pad 90. The threaded rod 140 is configured to move along the longitudinal axis 42. As the threaded rod 140 moves along the longitudinal axis 42, the recoil pad 90 moves along the longitudinal axis 42 thereby varying the length L of the recoil pad 90. The threaded rod 140 extends through an opening 132 in a plate 130 connected to the end of the buttstock 30 and mates with a nut 120 embedded in the end of the buttstock 30. The nut 120 is fixed translationally but is rotatable about the longitudinal axis 42. Rotating the nut 120 moves the threaded rod 140 towards and away from the plate 130 depending on the direction of the rotation thereby adjust the length L. For example, rotating the nut 120 in a first direction, such as forward or counterclockwise, may move the recoil pad 90 closer to the plate 130 decreasing the length L. Rotating the nut 120 in a second direction, such as backward or clockwise, may move the recoil pad 90 away from the plate 130 increasing the length L. A shooter may adjust the length L, thereby adjusting the length of pull, by rotating the nut 120.

As shown in FIG. 6, the adjustable recoil pad 90 may include a detent 190 positioned between the plate 130 and the nut 120. The detent 190 may be configured to interact with at least one detent position 180 on a surface 122 of the nut 120. In this example, the detent 190 may comprise a spring loaded ball bearing and each detent position 180 may comprise a recess in the surface 122 of the nut 120. As the nut 120 is rotated, the rotating force on the detent 190 disengages the detent 190 from the detent position 180 and slides the detent 190 along the surface 122 of the nut 120 until it reaches the next detent position 180. When the detent 190 meets the next detent position 180, the detent 190 engages with the detent position 180 and resists the rotational movement of the nut 120. The detent 190 stops the nut 120 from moving until a force on the nut 120 overcomes the resisting force from the detent 190.

Figure 7:
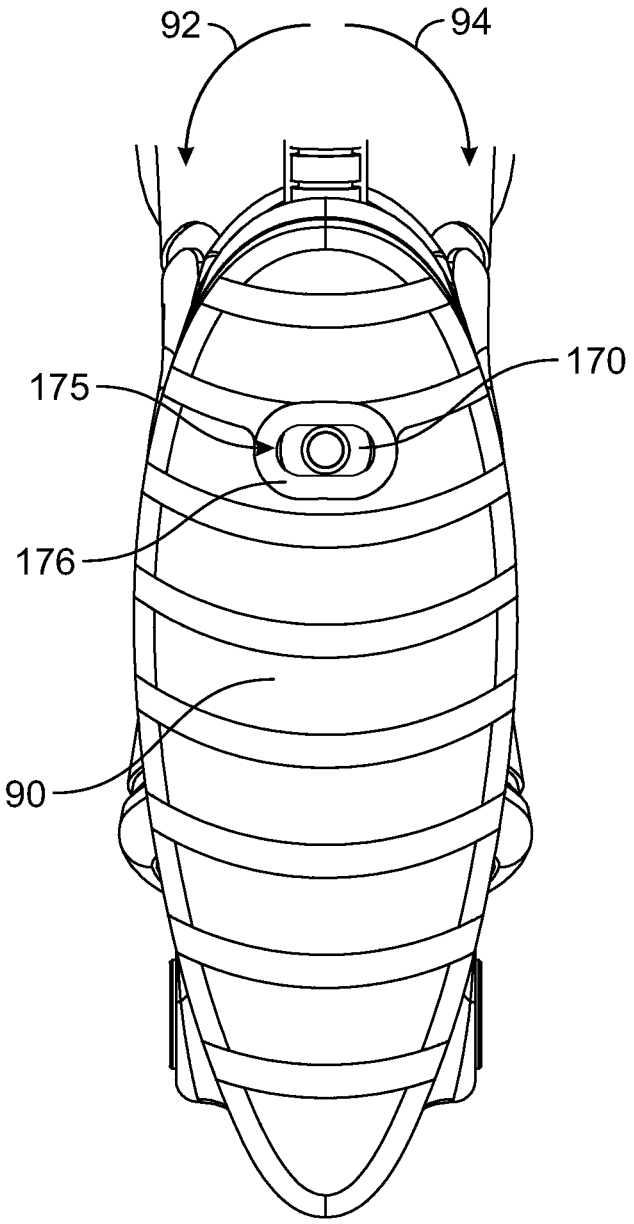
FIG. 7 is a front view of the example adjustable recoil pad according to the invention.

As shown in FIGS. 2, 6, and 7, a guide rod 170 may be attached to the recoil pad 90 to adjust the rotational position of the recoil pad 90 about the longitudinal axis 42. As shown in FIG. 2, the guide rod 170 extends through a second opening 134 in the plate 130 and into the chamber 50 allowing the guide rod 170 to move along the longitudinal axis 42 as the length L of the recoil pad 90 is adjusted via the threaded rod 140 and nut 120. With reference to FIG. 7, the shooter may adjust the rotation in a first direction 92 or a second direction 94 to cant the recoil pad 90 left or right. After the recoil pad 90 is adjusted to a desired rotation, the guide rod 170 may be tightly secured (e.g., fastened) to the recoil pad 90 to lock the rotational position of the recoil pad 90. As shown in FIG. 6, the guide rod 170 may be secured to the recoil pad 90 via a fastener 174.

Figure 8:
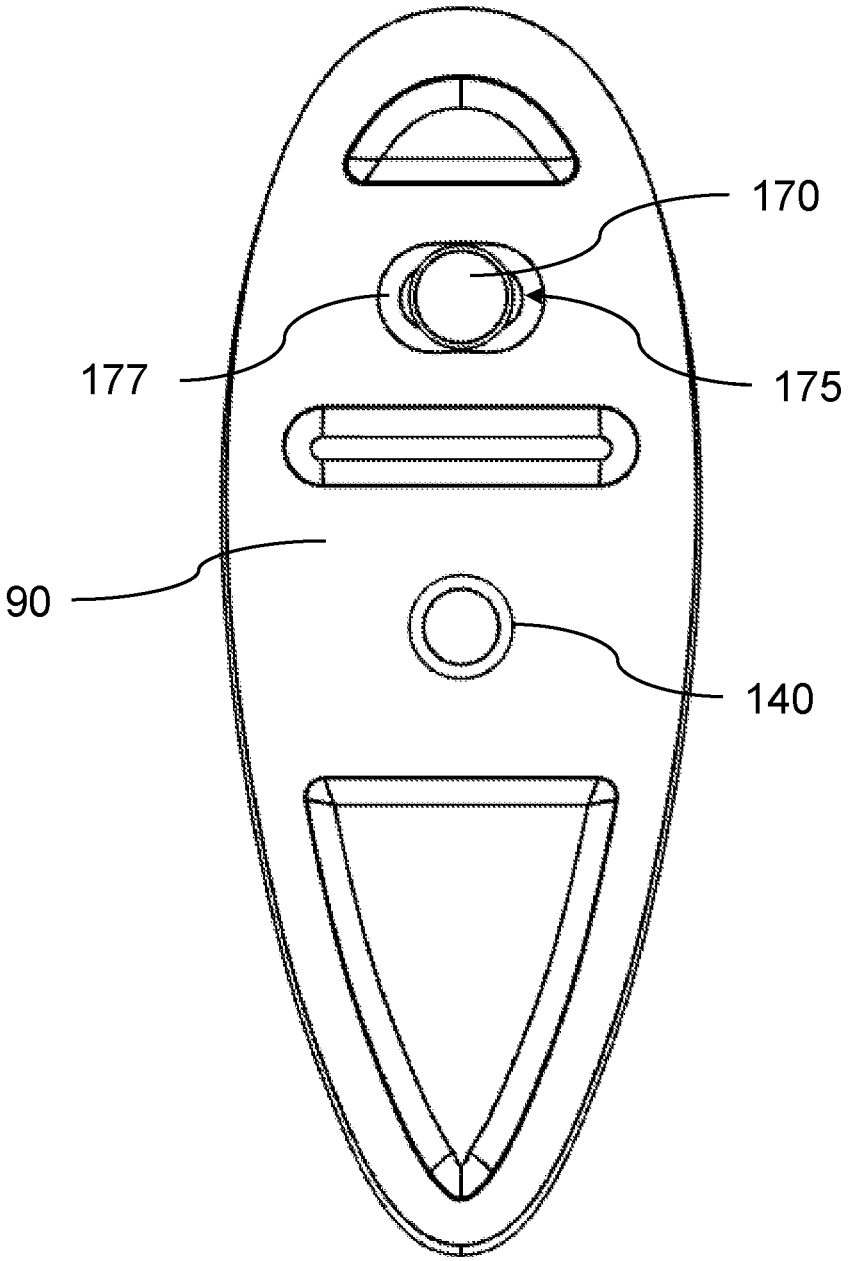
FIG. 8 is a rear view of the example adjustable recoil pad with an example threaded rod and guide rod according to the invention.

In this example, the recoil pad 90 includes corresponding elongated recesses 176, 177 on the exterior and interior surfaces of the recoil pad 90 (elongated recess 176 on the exterior surface shown in FIG. 7 and elongated recess 177 on the interior surface shown in FIG. 8) and a slotted opening 175 within the recesses. The elongated recess 177 on the interior surface may have a width corresponding to a diameter of the end of the guide rod 170. The elongated recess 176 on the exterior surface of the recoil pad 90 may have a width corresponding to a diameter of a head of the fastener 174. The slotted opening 175 within the recesses 176, 177 may have a width corresponding to a diameter of a shaft of the fastener 174. When the fastener 174 is removed (as shown in FIG. 7) or loosened, the end of the guide rod 170 may slide within the limits of the elongated recesses 176, 177 to allow the recoil pad 90 to rotate a desired degree clockwise and counterclockwise about the longitudinal axis 42. For example, the recoil pad 90 may rotate 5° clockwise or counterclockwise. When the recoil pad 90 is rotated to a desired position, the shaft of the fastener 174 may be inserted into the guide rod 170 through the slotted opening 175 and tightened to lock the position of the recoil pad 90. The fastener 174 is tightened until the head of the fastener 174 clamps the recessed surfaces 176, 177 of the recoil pad 90 against the end of the guide rod 170 thereby fixing the recoil pad 90 at a desired rotation. As shown in FIG. 6, the guide rod 170 may also include an opening 172 configured to receive a rigid structure, for example a shaft of a screwdriver. A shooter may insert the rigid structure in the opening 172 to prevent the guide rod 170 from rotating as the fastener 174 is tightened in or loosened from the guide rod 170.

It is expected that the example buttstock 30 including an adjustable comb 60 and/or recoil pad 90 according to the invention will allow a shooter to adjust a firearm to fit the shooter's physique and improve the shooter's marksmanship.

All of the embodiments of the claimed invention described herein are provided expressly by way of example only. Innumerable variations and modifications may be made to the example embodiments described herein without departing from the concept of this disclosure. Additionally, the scope of this disclosure is intended to encompass any and all modifications and combinations of all elements, features, and aspects described in the specification and claims, and shown in the drawings. Any and all such modifications and combinations are intended to be within the scope of this disclosure.

What is claimed is:

1. A stock for a firearm, said stock comprising:

a body extending along a longitudinal axis;

a chamber positioned within said body and defined by an inner surface of said body, said chamber comprising an opening providing access to said chamber;

a comb positioned on said body overlying said chamber;

a rod connected to said comb, said rod configured to extend through said opening into said chamber; and a latch comprising a first engagement surface positioned within said chamber, said latch movable between a first position in which said first engagement surface engages said rod to fix a position of said comb, and a second position in which said first engagement surface does not engage said rod thereby permitting motion of said comb relative to said body, wherein said rod and said comb are movable along a first axis oriented transversely to said longitudinal axis.

2. The stock of claim 1, wherein said latch comprises a sleeve positioned within said chamber and connected to said body and a plunger movable between said first position and said second position within said sleeve.

3. The stock of claim 2, wherein said plunger comprises a first engagement surface and said rod comprises a plurality of second engagement surfaces, said first engagement surface being configured to engage with a second engagement surface of the plurality of second engagement surfaces on said rod when said plunger is in said first position, said first engagement surface not engaging with said plurality of second engagement surfaces when said plunger is in said second position.

4. The stock of claim 3, wherein said first engagement surface comprises a pin connected to said plunger and said plurality of second engagement surface comprises a plurality of notches arranged lengthwise along said rod, wherein said pin is configured to engage with a notch of said plurality of notches when said plunger is in said first position, and said pin is disengaged from said notch when said plunger is in said second position.

5. The stock of claim 2, wherein said latch further comprises a spring acting between said plunger and said body, said spring pre-loaded to bias said plunger in said first position, wherein said plunger is moveable from said first position to said second position in response to a force acting on said plunger to compress said spring.

6. The stock of claim 1, further comprising:

a second rod comprising a protrusion positioned along a length of said second rod, said second rod connected to said comb; and a second opening in said body providing access to said chamber, said second rod configured to extend through said second opening into said chamber, wherein said protrusion extends radially out from said second rod past said second opening to prevent said second rod from moving further into said chamber and to set a lower stopping point of said comb.

7. The stock of claim 1, further comprising:

a nut embedded in an end of said body, said nut fixed translationally and rotatable about said longitudinal axis;

a plate connected to said end and overlying said nut, said plate comprising an opening providing access to said nut;

a recoil pad positioned on said end overlying said plate; and a threaded rod connected to said recoil pad, said threaded rod configured to extend through said opening in said plate and mate with said nut;

wherein said threaded rod and said recoil pad are movable along said longitudinal axis by rotating said nut to adjust a length between said recoil pad and said end.

8. The stock of claim 7, wherein said recoil pad is moveable closer to said plate in response to rotating said nut a first direction, and wherein said recoil pad is moveable away from said plate in response to rotating said nut a second direction.

9. The stock of claim 7, further comprising a detent positioned between said plate and said nut, said detent configured to interact with at least one detent position on a surface of said nut.

10. The stock of claim 7, further comprising a guide rod adjustably attached to said recoil pad via a fastener, said guide rod extending through a second opening in said plate and movable along said longitudinal axis, wherein said recoil pad comprises at least one slotted recess and a slotted opening positioned within said slotted recess, and an end of said guide rod and a head of said fastener are positioned on either side of said slotted opening to allow said recoil pad to cant a first direction or a second direction within the boundary of said slotted recess.

11. A firearm, said firearm comprising:

a barrel;

a receiver connected to said barrel;

a firing mechanism connected to said receiver; and a stock configured to connect to said barrel, said receiver and said firing mechanism, said stock comprising:

a body extending along a longitudinal axis;

a chamber positioned within said body and defined by an inner surface of said body, said chamber comprising an opening providing access to said chamber;

a comb positioned on said body overlying said chamber;

a rod connected to said comb, said rod configured to extend through said opening into said chamber; and a latch comprising a first engagement surface positioned within said chamber, said latch movable between a first position in which said first engagement surface engages said rod to fix a position of said comb, and a second position in which said first engagement surface does not engage said rod thereby permitting motion of said comb relative to said body, wherein said rod and said comb are movable along a first axis oriented transversely to said longitudinal axis.

12. The firearm of claim 11, wherein said latch comprises a sleeve positioned within said chamber and connected to said body and a plunger movable between said first position and said second position within said sleeve.

13. The firearm of claim 12, wherein said plunger comprises a first engagement surface and said rod comprises a plurality of second engagement surfaces, said first engagement surface engaging with a second engagement surface of the plurality of second engagement surfaces on said rod when said plunger is in said first position, said first engagement surface not engaging with said plurality of second engagement surfaces when said plunger is in said second position.

14. The firearm of claim 13, wherein said first engagement surface comprises a pin connected to said plunger and said second engagement surface comprises a plurality of notches arranged lengthwise along said rod, said pin engages with a notch of said plurality of notches when said plunger is in said first position, and said pin is disengaged from said notch when said plunger is in said second position.

15. The firearm of claim 12, wherein said latch further comprises a spring acting between said plunger and said body, said spring pre-loaded to hold said plunger in said first position, wherein said plunger is moveable from said first position to said second position in response to a force acting on said plunger that compresses said spring.

16. The firearm of claim 11, wherein said stock further comprises:

a second rod comprising a protrusion positioned along a length of said second rod, said second rod connected to said comb; and a second opening in said body providing access to said chamber, said second rod configured to extend through said second opening into said chamber, wherein said protrusion extends radially out from said second rod past said second opening to prevent said second rod from moving further into said chamber and to set a lower stopping point of said comb.

17. The firearm of claim 11, wherein said stock further comprises:

a nut embedded in an end of said body, said nut fixed translationally and rotatable about said longitudinal axis;

a plate connected to said end and overlying said nut, said plate comprising an opening providing access to said nut;

a recoil pad positioned on said end overlying said plate; and a threaded rod connected to said recoil pad, said threaded rod configured to extend through said opening in said plate and mate with said nut;

wherein said threaded rod and said recoil pad are movable along said longitudinal axis by rotating said nut to adjust a length between said recoil pad and said end.

18. The firearm of claim 17, wherein said recoil pad is moveable closer to said plate in response to rotating said nut a first direction, and wherein said recoil pad is moveable away from said plate in response to rotating said nut a second direction.

19. The firearm of claim 17, wherein said stock further comprises a detent positioned between said plate and said nut, said detent configured to interact with at least one detent position on a surface of said nut.

20. The firearm of claim 17, further comprising a guide rod adjustably attached to said recoil pad via a fastener, said guide rod extending through a second opening in said plate and movable along said longitudinal axis, wherein said recoil pad comprises at least one slotted recess and a slotted opening positioned within said slotted recess, and an end of said guide rod and a head of said fastener are positioned on either side of said slotted opening to allow said recoil pad to cant a first direction or a second direction within the boundary of said slotted recess.

* * * * *